US007431186B2

(12) United States Patent
Hsu

(10) Patent No.: US 7,431,186 B2
(45) Date of Patent: Oct. 7, 2008

(54) STAPLERS WITH EFFORT-SAVING ARM ASSEMBLY

(76) Inventor: Hung Chieh Hsu, No. 222, Guozhong Road, Dali City, Taichung Hsien (TW) 412

( * ) Notice: Subject to any disclaimer, the term of this patent is extended or adjusted under 35 U.S.C. 154(b) by 0 days.

(21) Appl. No.: 11/898,415

(22) Filed: Sep. 12, 2007

(65) Prior Publication Data

US 2008/0029568 A1 Feb. 7, 2008

Related U.S. Application Data

(63) Continuation-in-part of application No. 11/386,714, filed on Mar. 23, 2006, now abandoned.

(51) Int. Cl.
*B25C 5/11* (2006.01)

(52) U.S. Cl. ..... 227/120; 227/134; 227/139; 227/143; 227/144

(58) Field of Classification Search ..... 227/120, 227/134, 139, 143, 144
See application file for complete search history.

(56) References Cited

U.S. PATENT DOCUMENTS 4,288,019 A 9/1981 Dahle
4,463,890 A * 8/1984 Ruskin ..... 227/132
4,878,608 A 11/1989 Mitsuhashi
4,984,729 A 1/1991 Balma
5,038,992 A 8/1991 Shiang et al.
5,356,063 A 10/1994 Perez
5,421,502 A 6/1995 Huang
5,704,533 A 1/1998 Chang
5,931,365 A * 8/1999 Huang ..... 227/109
6,142,355 A 11/2000 Wu
7,118,019 B2 10/2006 Marks
7,124,922 B2 10/2006 Marks
2007/0057011 A1 * 3/2007 Kandasamy et al. ..... 227/134
2007/0057012 A1 * 3/2007 Kandasamy et al. ..... 227/134
2007/0221699 A1 * 9/2007 Hsu ..... 227/134

* cited by examiner

*Primary Examiner*—Brian D. Nash
(74) *Attorney, Agent, or Firm*—Bacon & Thomas, PLLC

(57) ABSTRACT

A stapler includes a base which has two connection plates on a top thereof and each connection plates include three holes. A magazine has one end pivotably connected to the hole located at the rear end of the base and staples are received in the magazine. A first arm has two grooves in the two sidewalls of the rear end thereof and is pivotably connected to the second hole of the connection plates. A second arm located between the first arm and the magazine, a rear end of the second arm movably engaged with the two grooves in the first arm. The second arm is pivotably connected to the third holes of the connection plates.

5 Claims, 6 Drawing Sheets

(A)

(B)

STAPLERS WITH EFFORT-SAVING ARM ASSEMBLY

FIELD OF THE INVENTION

This application is a continuation-in-part application of Applicant's former patent application Ser. No. 11/386,714, filed on Mar. 23, 2006.

BACKGROUND OF THE INVENTION

A conventional stapler 90 is shown in FIG. 5 and generally includes a base with an anvil 97 on a top of a first end of the base and a connection portion 91 on a second end of the base. A U-shaped frame 92 is connected to a pivot hole 96 in the connection portion 91 of the base and an arm 93 is located above the U-shaped frame 92 and pivotably connected to the U-shaped frame 92 by a pin 94 extending through the pivot hole 96. Staples are received in the U-shaped frame 92 which has an outlet defined in an underside of the front end thereof, a plate 95 is connected to an underside of the arm 93 so as to push the staples through the outlet, the two legs of the staple penetrate a pile, of paper sheets and are bent by the anvil 97 to staple the paper sheets.

When the arm 93 is pivoted downward, the force has to be large enough to penetrate the two legs of the staple to penetrate through the paper sheets to successfully staple the paper sheets. However, the user's hand does not feel comfortable after frequent stapling actions.

The present invention intends to provide an effort saving stapler wherein two leverage mechanisms are employed to generate a large force to the staples while only limited force is applied to the arm.

SUMMARY OF THE INVENTION

The present invention relates to a stapler which comprises a base having two connection plates on a top of a rear end thereof and each of the connection plates has a first hole toward the rear end of the base, a third hole toward a front end of the base, and a second hole located between the first and the third hole. A magazine for receiving staples and a rear end of the magazine is pivotably connected with the first holes in the connection plates. A first arm has a hole defined transversely through two sidewalls thereof and a second pin extends through the holes in the first arm and the second holes of the connection plates. Two grooves are defined through the two sidewalls of a rear end of the first arm. A second arm is located between the first arm and the magazine. A rear end of the second arm is movably engaged with the two grooves in the first arm. Two holes are defined transversely through two sidewalls of the second arm and a third pin extends through the holes in the second arm and the third holes of the two connection plates. An action plate is connected to a front end of the second arm and located corresponding to the outlet.

A distance from the second holes to the front end of the first arm is longer than a distance from the rear end of the second arm to the second holes of the connection plates. A distance from the rear end of the second arm to the third holes of the connection plates is longer than a distance from the front end of the second arm to the third holes of the connection plates.

The present invention will become more obvious from the following description when taken in connection with the accompanying drawings.

DETAILED DESCRIPTION OF THE PREFERRED EMBODIMENT

Figure 1:
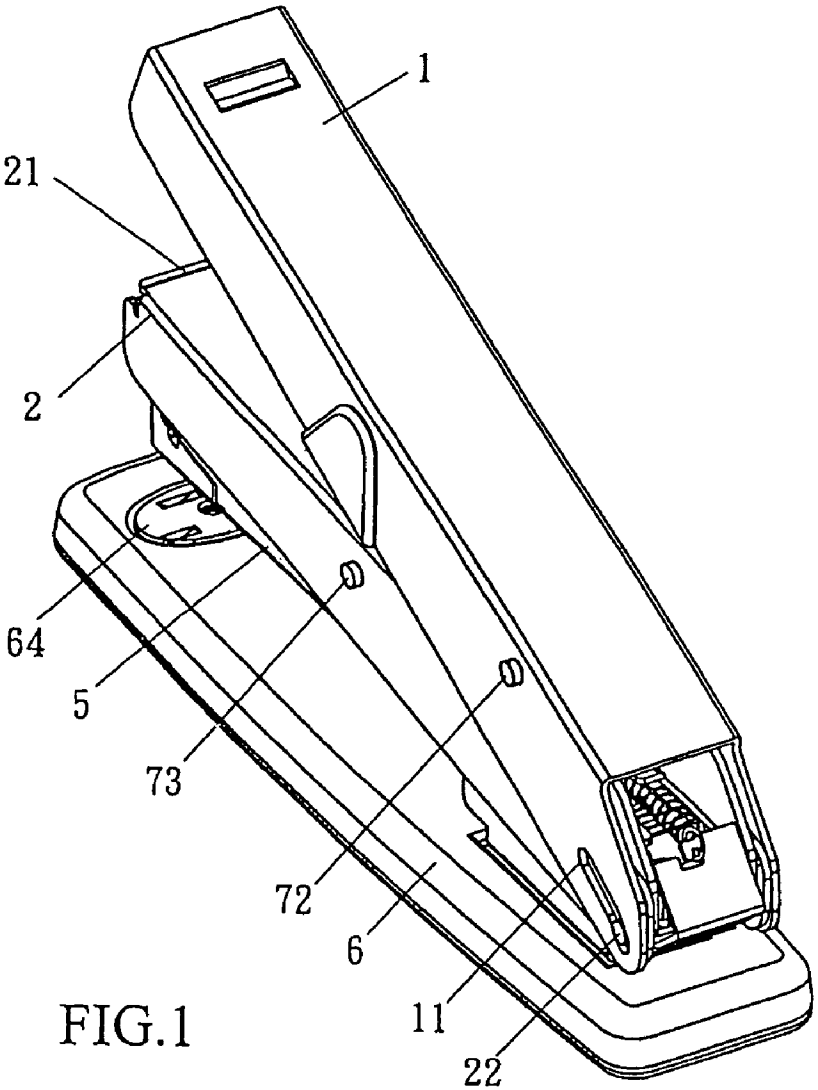
FIG. 1 is a perspective view to show the stapler of the present invention.
Figure 2:
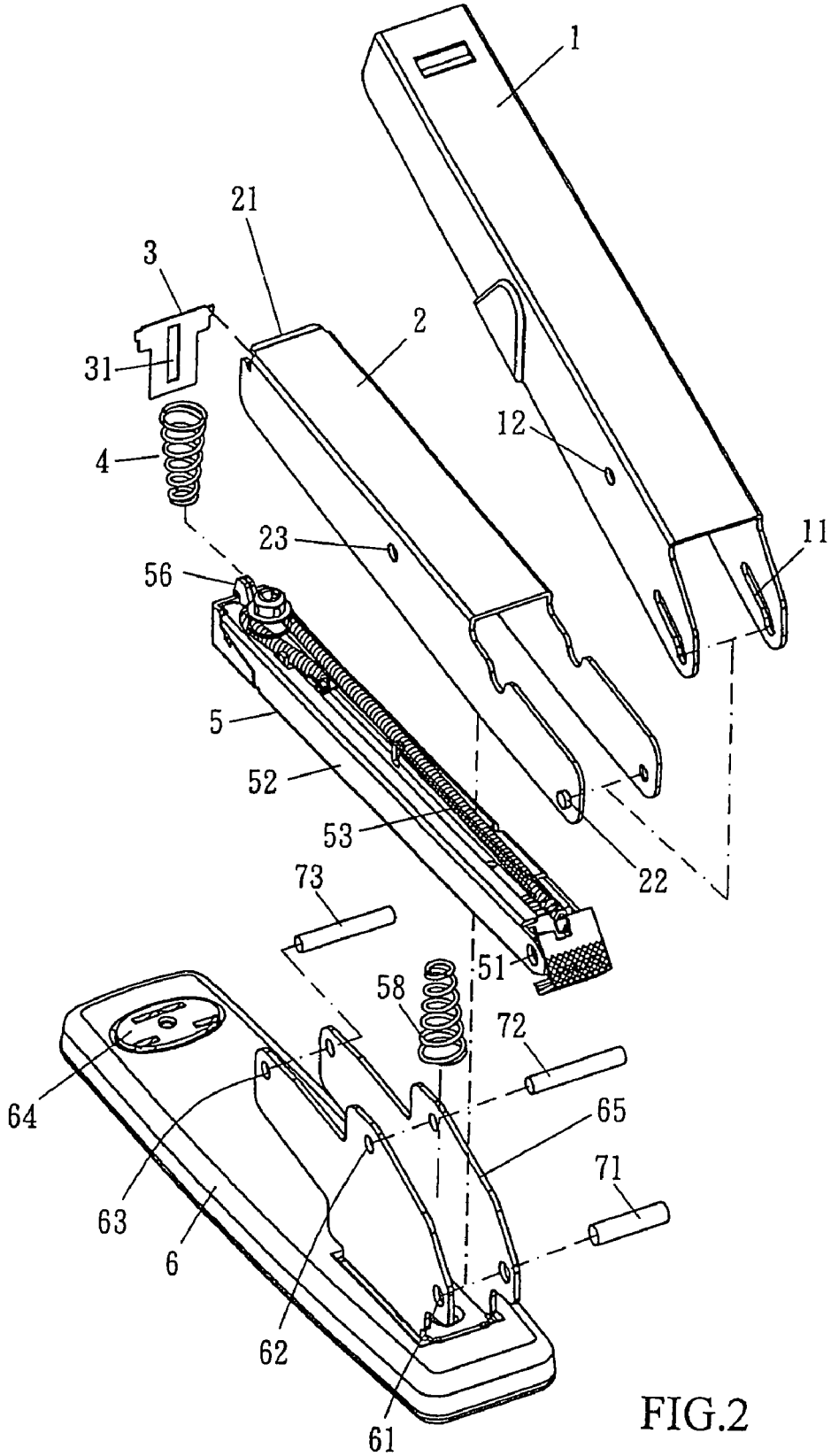
FIG. 2 is an exploded view to show the stapler of the present invention.
Figure 3:
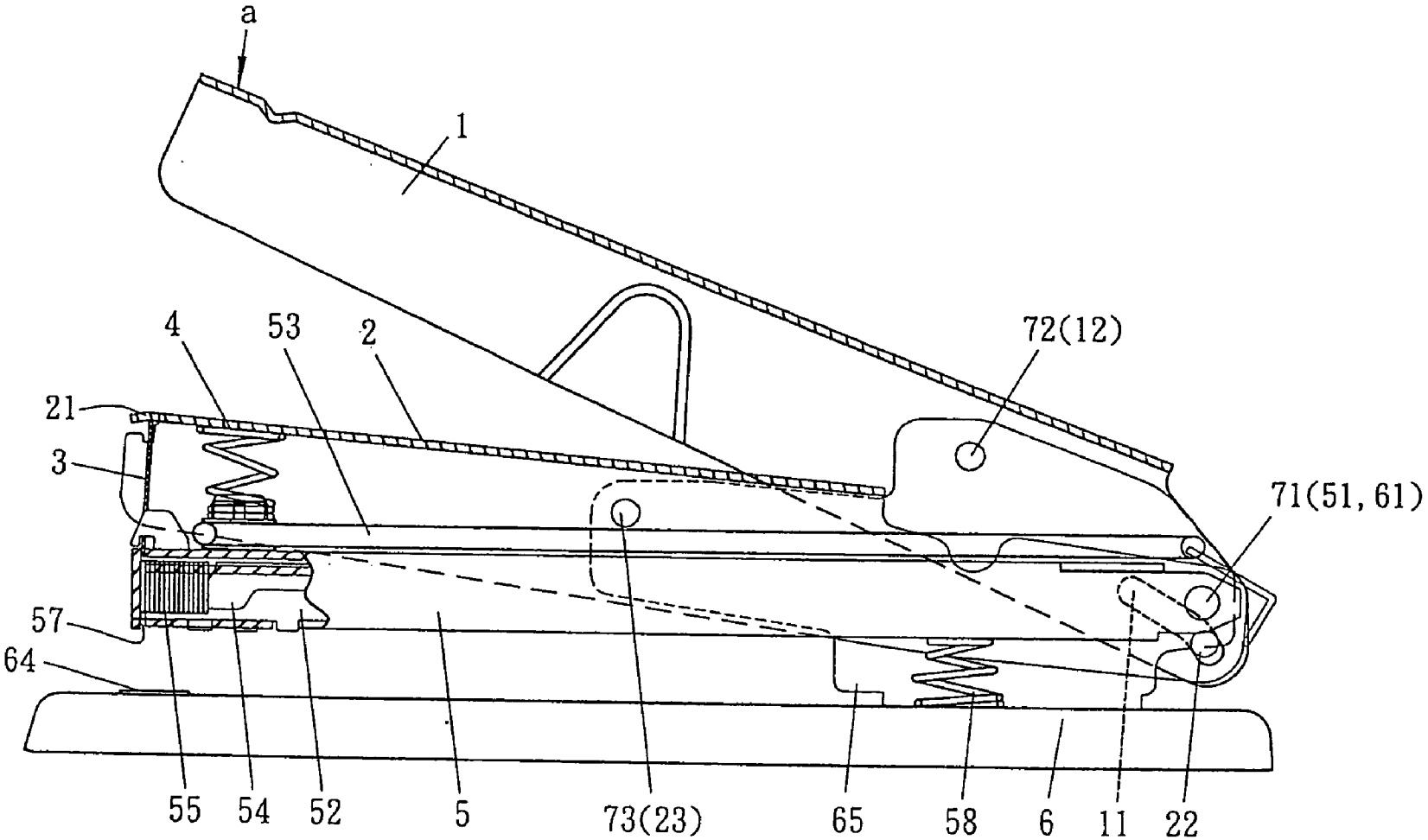
FIG. 3 is a side view to show the stapler of the present invention.

Referring to FIGS. 1 to 3, the stapler of the present invention comprises a base 6 having two connection plates 65 on a top of a rear end thereof and each of the connection plates 65 includes a first hole 61 toward the rear end of the base 6, a third hole 63 toward a front end of the base 6, and a second hole 62 located between the first and the third hole 61, 63. An anvil 64 is fixed on the top of the front end of the base 6.

A magazine 5 includes a space 52 defined therein so that staples 55 are received in the space 52. An outlet 57 is defined in an underside of a front end of the magazine 5. A hole 51 is defined through a rear end of the magazine 5 and pivotably connected with the first holes 61 in the connection plates 65 by a first pin 71. A spring 58 is connected between the base 6 and the magazine 5. A spring 53 has one end fixed to the rear end of the magazine 5 and the other end of the spring 53 goes around a protrusion and bends backward and is connected to a push member 54 which pushes the staples 55 toward the front end of the magazine 5.

A first arm 1 has a hole 12 defined transversely through two sidewalls thereof and a second pin 72 extends through the holes 12 in the first arm 1 and the second holes 62 of the connection plates 65. Two inclined grooves 11 are defined through the two sidewalls of a rear end of the first arm 1 and the inclined grooves 11 are oriented with a higher left end and a lower right end as shown in FIGS. 3, 4A and 4B.

A second arm 2 is located between the first arm 1 and the magazine 5. A spring 4 is connected between the front end 21 of the second arm 2 and the front end of the magazine 5. A rear end of the second arm 2 includes two protrusions 22 extending from two respective outsides the two sidewalls of the rear end of the second arm 2. The protrusions 22 are movably engaged with the grooves 11 in the rear end of the first arm 1. Two holes 23 are defined transversely through the two sidewalls of the second arm 2 and a third pin 73 extends through the holes 23 in the second arm 2 and the third holes 63 of the two connection plates 65. An action plate 3 is connected to an underside of a front end 21 of the second arm 2 and located corresponding to the outlet 57. The action plate 3 has a slot 31 and the magazine 5 has a hook 56 on the front end thereof, the hook 56 hooks the slot 31 of the action plate 3.

Figure 4:
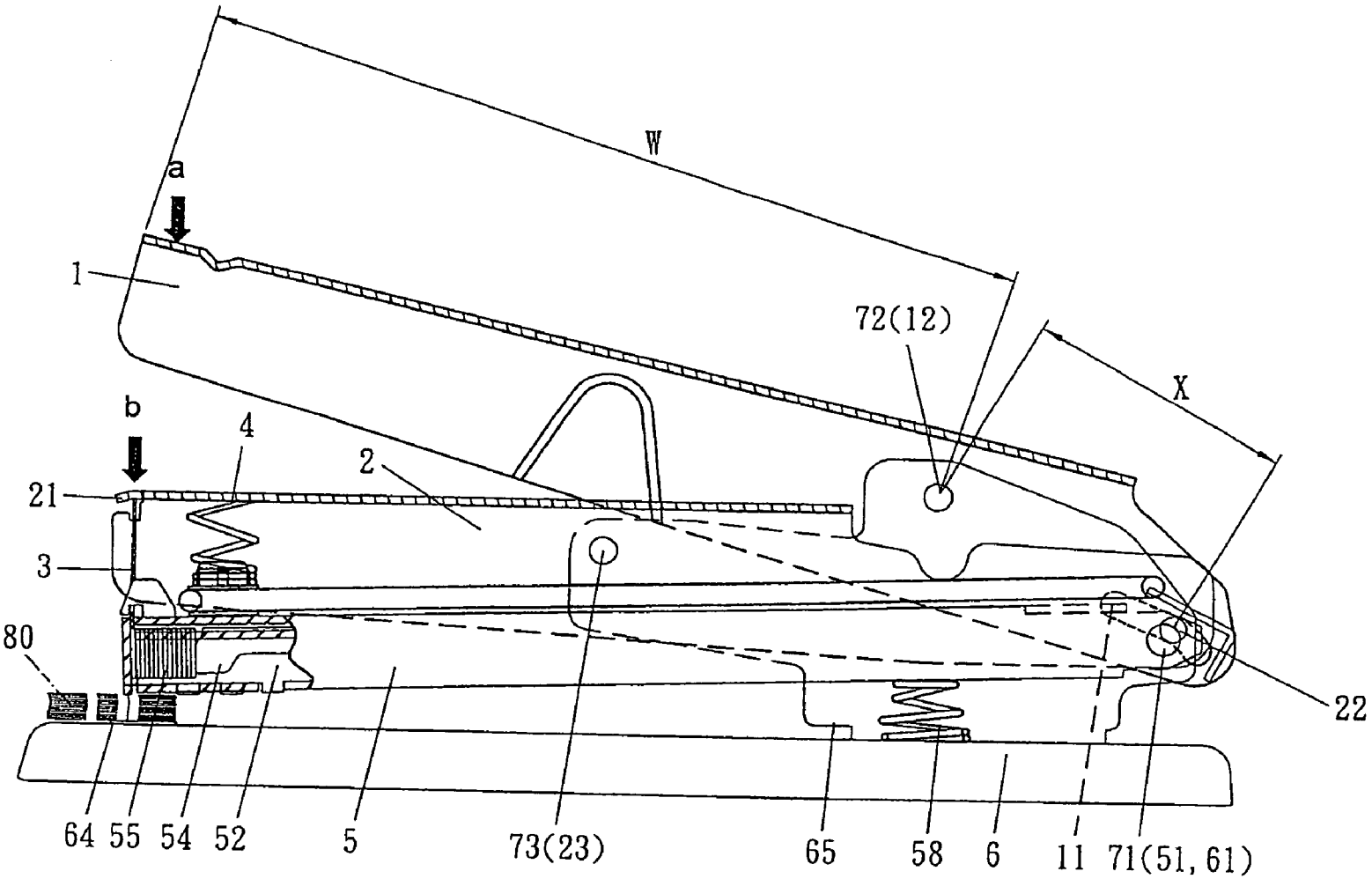
FIG. 4A shows that the arm is pivoted.
FIG. 4B shows that the arm is completely pivoted and the staple penetrates through sheets.
Figure 4:
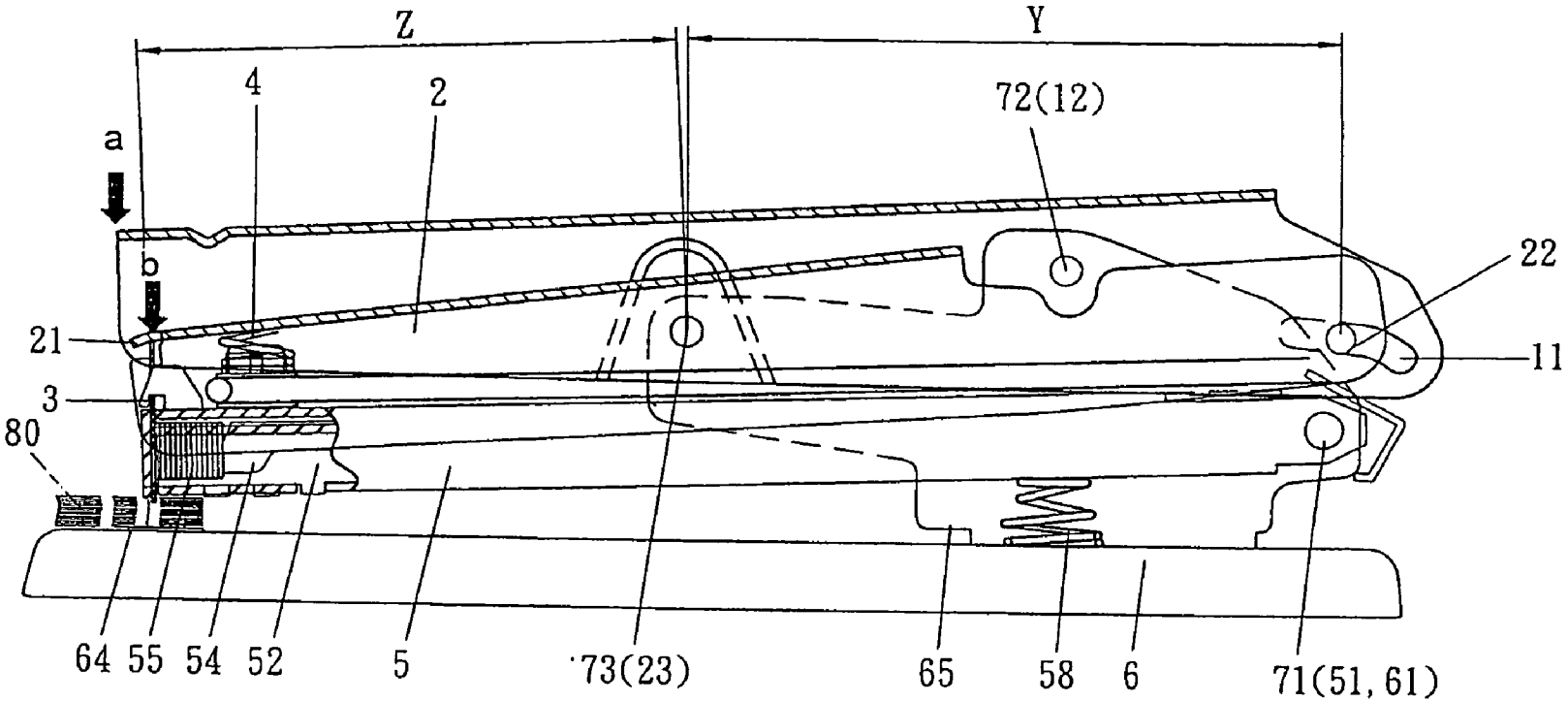
Figure 5:
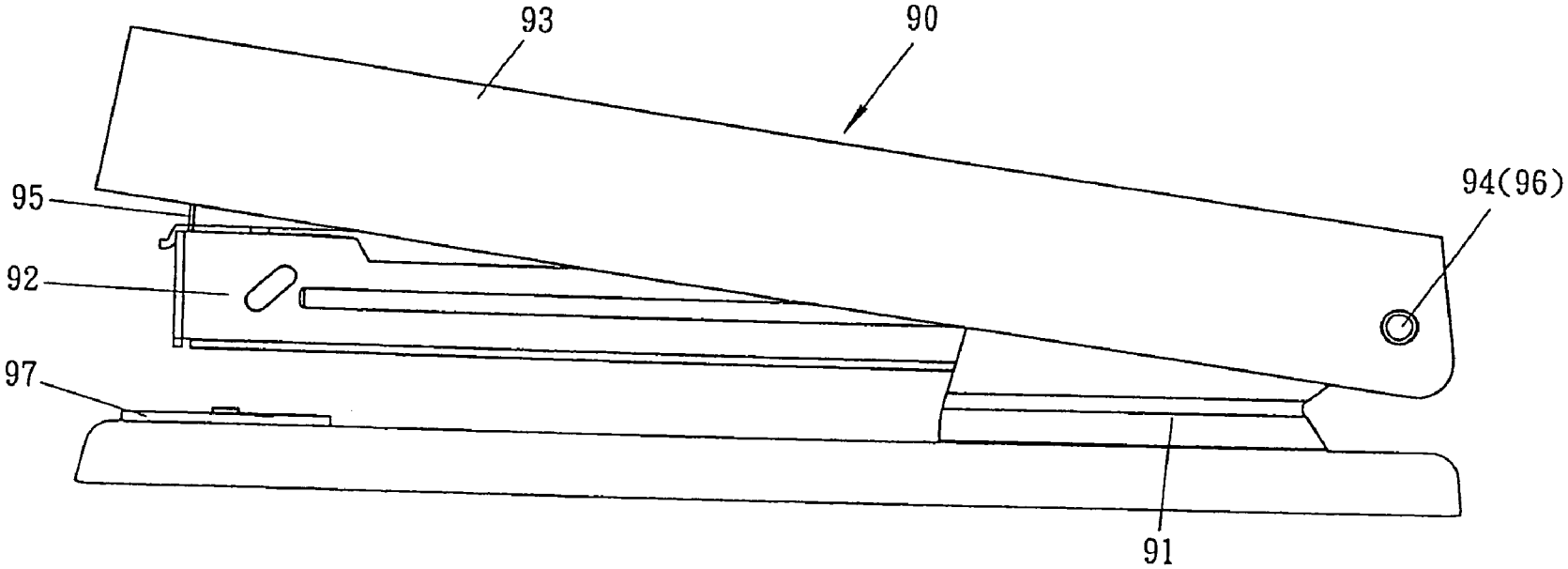
FIG.5 PRIOR ART
FIG. 5 shows a conventional stapler.

As shown in FIGS. 4A and 4B, a distance "W" from the second holes 62 to the front end of the first arm 1 is longer than a distance "X" from the rear end of the second arm 2 to the second holes 62 of the connection plates 65. When the user applies a force "a" to the front end of the first arm 1, the first arm 1 is pivoted about the second pin 72 and the protrusions 22 are moved within the grooves 11. The downward movement of the first arm 1 pivots the second arm 2 and the second arm 2 is pivoted about the third pin 73 and applies a force "b" to the front end 21 of the second arm 2. The action plate 31 pushes a staple 55 out from the outlet 57 to penetrate the paper sheets 80 located between the anvil 64 on the base 6 and the magazine 5.

It is noted that a distance "Y" from the rear end of the second arm 2 to the third holes 63 of the connection plates 65 is longer than a distance "Z" from the front end of the second arm 2 to the third holes 63 of the connection plates 65.

Therefore, the user simply applies a force "a" on the first arm 1, the first arm 1 is pivoted about the second pin 72 and the protrusions 22 move from the right inner end of the grooves 11 (FIG. 3) toward the left. The relative movement of the protrusions 22 to the grooves 11 from the right to the left pivots the second arm 2 about the third pin 73 so that the second arm 2 is pivoted by the force generated by the relative movement of the protrusions 22 and generates a force "b" to push the staples 55. In other words, the user simply applies a small force on the first arm 1, the second arm 2 generates a large force to push the staples 55.

What is claimed is:

1. A stapler comprising:

a base having two connection plates on a top of a rear end thereof and each of the connection plates having a first hole toward the rear end of the base, a third hole toward a front end of the base, and a second hole located between the first and the third hole, an anvil fixed on the top of the front end of the base;

a magazine having a space defined therein and staples received in the space, a hole defined through a rear end of the magazine and pivotably connected with the first holes in the connection plates by a first pin, an outlet defined in an underside of a front end of the magazine;

a first arm having a hole defined transversely through two sidewalls thereof and a second pin extending through the holes in the first arm and the second holes of the connection plates, two inclined grooves defined through the two sidewalls of a rear end of the first arm;

a second arm located between the first arm and the magazine, a rear end of the second arm movably engaged with the two grooves in the first arm, two holes defined transversely through two sidewalls of the second arm and a third pin extending through the holes in the second arm and the third holes of the two connection plates, an action plate connected to a front end of the second arm and located corresponding to the outlet, and a distance (W) from the second holes to the front end of the first arm being longer than a distance (X) from the rear end of the second arm to the second holes of the connection plates, a distance (Y) from the rear end of the second arm to the third holes of the connection plates being longer than a distance (Z) from the front end of the second arm to the third holes of the connection plates.

2. The stapler as claimed in claim 1, wherein the magazine has a hook on the front end thereof and the action plate has a slot with which the hook is engaged.

3. The stapler as claimed in claim 1, wherein a spring is connected between the base and the magazine.

4. The stapler as claimed in claim 1, wherein a spring is connected between the front end of the second arm and the front end of the magazine.

5. The stapler as claimed in claim 1, wherein two protrusions extend from two respective outsides the two sidewalls of the rear end of the second arm, the protrusions movably engaged with the grooves in the rear end of the first arm.

* * * * *